US006598320B2

(12) United States Patent
Turner et al.

(10) Patent No.: US 6,598,320 B2
(45) Date of Patent: Jul. 29, 2003

(54) SHOE INCORPORATING IMPROVED SHOCK ABSORPTION AND STABILIZING ELEMENTS

(75) Inventors: Jerome A. Turner, Irvine, CA (US); Ralph Serna, Irvine, CA (US)

(73) Assignee: American Sporting Goods Corporation, Irvine, CA (US)

( * ) Notice: Subject to any disclaimer, the term of this patent is extended or adjusted under 35 U.S.C. 154(b) by 71 days.

(21) Appl. No.: 09/967,589

(22) Filed: Sep. 28, 2001

(65) Prior Publication Data

US 2003/0061731 A1 Apr. 3, 2003

(51) Int. Cl.[7] ..... A43B 13/18
(52) U.S. Cl. ..... 36/28; 36/29; 36/35 R
(58) Field of Search ..... 36/28, 29, 35 R, 36/37, 114, 25 R

(56) References Cited

U.S. PATENT DOCUMENTS

| | | | | | |
|---|---|---|---|---|---|
| 2,682,712 | A | * | 7/1954 | Owsen et al. | 36/107 |
| 4,608,768 | A | | 9/1986 | Cavanagh | |
| 4,845,863 | A | | 7/1989 | Yung-Mao | |
| 5,331,750 | A | * | 7/1994 | Sasaki et al. | 36/28 |
| 5,343,639 | A | * | 9/1994 | Kilgore et al. | 36/29 |
| 5,493,791 | A | | 2/1996 | Kramer | |
| 5,718,063 | A | * | 2/1998 | Yamashita et al. | 36/28 |
| 5,771,606 | A | * | 6/1998 | Litchfield et al. | 36/29 |
| 5,918,384 | A | | 7/1999 | Meschan | |
| 6,026,593 | A | * | 2/2000 | Harmon-Weiss et al. | 36/28 |
| 6,115,943 | A | * | 9/2000 | Gyr | 36/35 R |
| 6,354,020 | B1 | * | 3/2002 | Kimball et al. | 36/29 |

* cited by examiner

*Primary Examiner*—M. D. Patterson
(74) *Attorney, Agent, or Firm*—Michael A. Painter

(57) ABSTRACT

The invention is directed to a midsole assembly for footwear which includes medial and lateral unsymmetrical stabilizing pods disposed between shock absorbing upper and lower deflectable plates positioned at the heel portion of the midsole. The upper plate is adapted to engage the bottom surface of the midsole and includes an axially aligned, concave segment which is resiliently deflected upon the imposition of force thereon by the user's foot. The bottom plate includes a deflectable concave segment which is adapted to engage the deflectable segment of the upper plate and be urged downwardly upon the imposition of force upon the upper plate by the user's foot. The medial and lateral stabilizing pods are mounted between the upper and lower plates along the medial and lateral sides of the heel portion of the midsole and are respectively adapted to dynamically respond to the forces imposed on the medial and lateral sides of the heel. To control pronation and supination of the shoe and user's foot, the hardness of the medial stabilizing pod may be greater than that of the lateral stabilizing pod.

22 Claims, 9 Drawing Sheets

SHOE INCORPORATING IMPROVED SHOCK ABSORPTION AND STABILIZING ELEMENTS

BACKGROUND OF THE INVENTION

1. Field of the Invention

The present invention generally relates to foot-wear construction and in particular to the use of multiple shock absorption and stabilizing members incorporated into the heel portion of the midsole of the footwear.

2. Prior Art

The result of the increased popularity of exercise, as well as the necessities of everyday walking and standing, it has been recognized there is a need to alleviate and relieve the stress imposed on a person's feet and legs. In particular, it is essential that shoes and other like footwear provide for suitable shock absorption and stability. This is particularly important where the shoes or footwear are to be used in active pursuits such as running or other athletic endeavors.

As a general rule, it is the midsole of a shoe that provides the cushioning and stability to the foot of a user. In conventional shoes used for athletic purposes, either polyurethane foam, EVA (ethyl vinyl acetate) foam or perhaps HYTREL foam is used as the material which provides most of the cushioning of the shoe (HYTREL is a trademark of DuPont de Numerus & Co.). As stated, advanced shock absorption and stability is particularly required in athletic footwear where the user's foot is exposed to repeated shocks from footstep impact in running and other athletic activities.

The prior art discloses a variety of footwear designs which have been developed for the purpose of improving shock absorption and stability. These prior art designs range from merely constructing the shoe sole from a softer, more resilient material to incorporating fluid-filled pads or bladders in the midsole of a shoe. In many shoe midsoles designed to increase the cushioning effects of the shoe, the increased resiliency or softness of the shoe sole provides no resistance to the tendency of the user's foot to rotate relative to the leg upon impact, a condition generally referred to as pronation. The tendency for excessive lowering of the medial margin of the foot or excessive pronation, and a tendency for an excessive raising of the medial margin of the foot, or supination, have the potential of causing injuries to the wearer of the shoe.

One of the footwear designs disclosed by the prior art comprises a pair of tabs extending from opposite sides of the outsole of the shoe to the heel counter of the shoe for the purpose of connecting the outsole to the heel counter and increasing the lateral medial stability of the shoe. In this design, the tabs are formed as an integral part of the shoe outsole and are bonded to a heel wedge layer and midsole layer of the shoe sole as well as the heel counter. The inadequacy of this design is inherent in its construction. Since the tabs are secured to the extreme outer edges of the heel wedge and midsole, this will reduce the ability of the tabs to resist compression of the heeled wedge and midsole in the areas of the wedge and midsole inside the shoe surrounding the user's foot.

Another design for footwear disclosed by the prior art employs one or more shock absorbers embedded within the heel portion of the midsole. The shock absorbers are typically air or fluid filled cylinders which can absorb the force of the heel and then return the energy in a controlled upward direction. Irrespective of the number of fluid filled cylinders embedded within the heel, excessive pronation of the user's foot will occur since the air cylinders cannot properly respond to the difference in forces imposed on the medial and lateral portions of the heel.

The present invention substantially resolves those deficiencies exhibited by the designs disclosed in the prior art. The present invention employs an assembly of structural elements to achieve a result which was previously attempted by changing the material of the midsole. The elements of the present invention used to stabilize the shoe from heel strike to toe off comprise a pair of non-symmetrical, multi-lobed pods disposed between the medial and lateral portions of upper and lower shock absorbing deflectable plates mounted within the heel portion of the sole. The deflectable plates and pods are deformable upon the imposition of force and will return to their original configuration upon the removal of force. The configuration of the upper and lower plates and the non-symmetrical, multi-lobed pods improve the stabilization characteristics of the footwear and to control excessive foot pronation or supination inherent in those footwear designs disclosed by the prior art.

SUMMARY OF THE INVENTION

The present invention relates to the structure of the sole of footwear which improves shock absorption and stability. The midsole of the footwear has a heel portion and forefoot portion and an upper and lower surface. In the heel portion of the midsole, the upper surface thereof is adapted to receive the user's heel. An upper shock absorbing deflectable plate is disposed adjacent the lower surface of the heel portion of the midsole. A central segment of the upper plate extending along the longitudinal axis thereof extends upwardly into an elongated concave surface which is disposed adjacent the bottom surface of the midsole. Upon the imposition of force on the midsole by the user's heel, the deflectable segment will be deformed downwardly to absorb shock. When the force is removed, the deflectable segment will return to its original position.

A lower plate includes a central concave deflectable segment positioned along the longitudinal axis thereof which is adapted to be positioned adjacent the deflectable segment of the upper plate. Upon the imposition of force upon the heel of the midsole, the deformation of the deflectable segment of the upper plate will be transmitted to the deflectable segment of the lower plate. When the force is removed, the deflectable segments of both the upper and lower plates will rebound to their original orientation.

A pair of unsymmetrical stabilizing pods are disposed between the upper and lower shock absorption plates. The medial pod extends from the medial side of the sole about the rear of the shoe. The lateral stabilizing pod is spaced from the medial pod and is positioned solely along the lateral side of the shoe. Each stabilizing pod is constructed and positioned to dynamically stabilize the shoe along the direction of impact. To avoid excess pronation or supination of the shoe and the user's foot, the hardness of the medial stabilizing pod may be greater than that of the lateral stabilizing pod.

It is an object of the present invention to provide a construction for a shoe sole which improves shock absorption and stability.

It is another object of the present invention to provide improved shock absorption and stability for a shoe through the use of cooperating shock absorbing elements.

It is still another object of the present invention to provide improved shock absorption for a shoe through the use of cooperating, deflectable plates responsive to the force of the user's foot.

It is still yet another object of the present invention to provide improved, dynamic stability for a shoe through the use of unsymmetrical stabilizing pods.

It is still yet another object of the present invention to provide a shoe incorporating an improved shock absorption and stability system which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
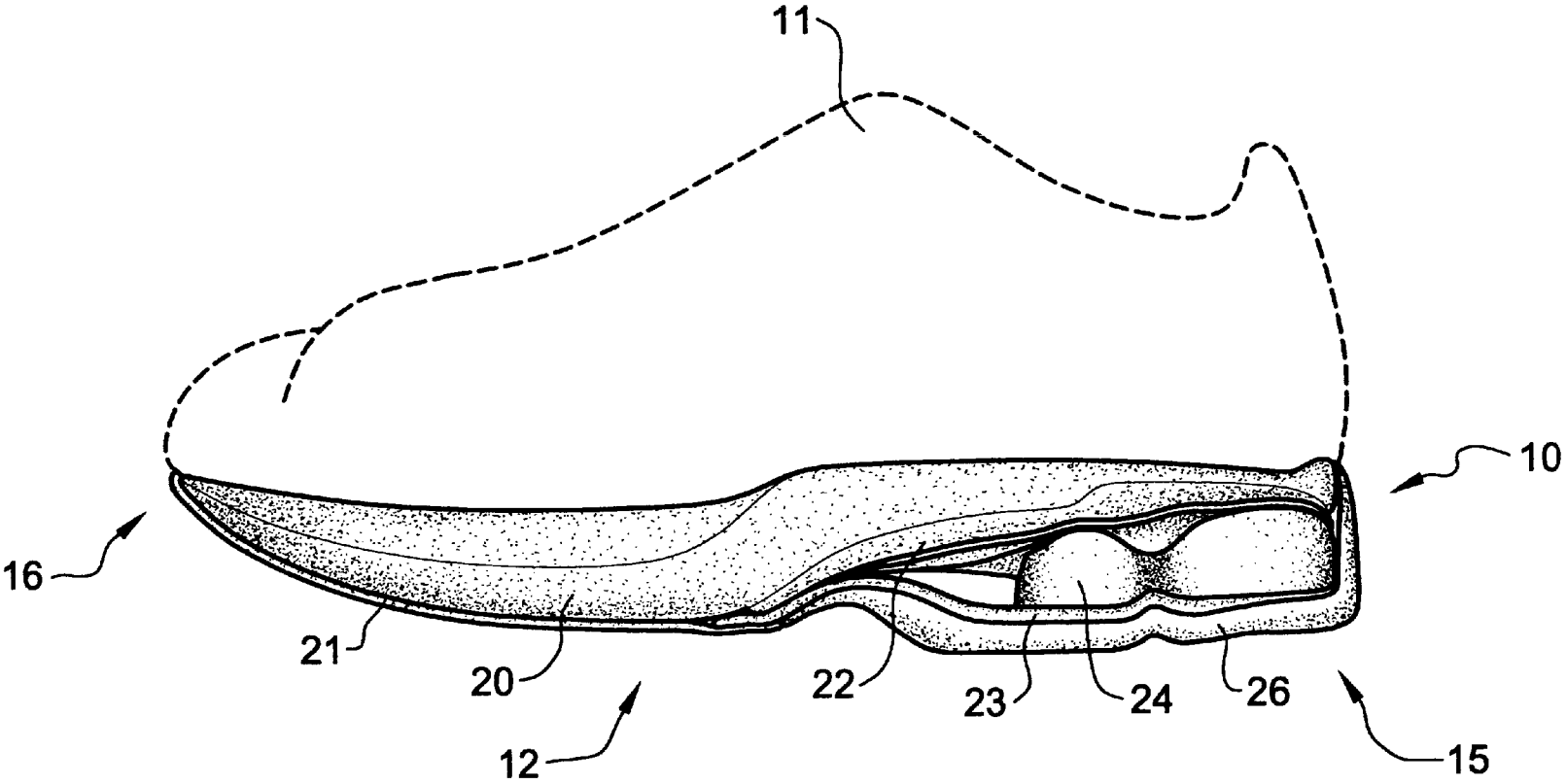
FIG. 1 is a medial side elevation view of a footwear construction in accordance with the present invention.

An understanding of the preferred embodiment of the present invention can be best gained by reference to FIG. 1 which illustrates the medial side of a shoe for use on the right foot of a user. The left shoe incorporating the present invention would be a mirror image of that shown in FIG. 1. A shoe 10 is shown having an upper 11 and a sole 12. Shoe 10 includes a medial side 13 and a lateral side 14, a heel region 15 and a forefoot region 16. The upper 11 used in conjunction with the present invention may be any conventional shoe upper, including an upper as might be found in an athletic shoe. Although the description of the present invention is directed toward athletic shoes, such as shoes used for running, basketball, aerobics and the like, it is understood the present invention may be incorporated into street shoes or boots such as hiking boots. Upper 11 may be attached to sole 12 in any conventional manner.

Figure 5:
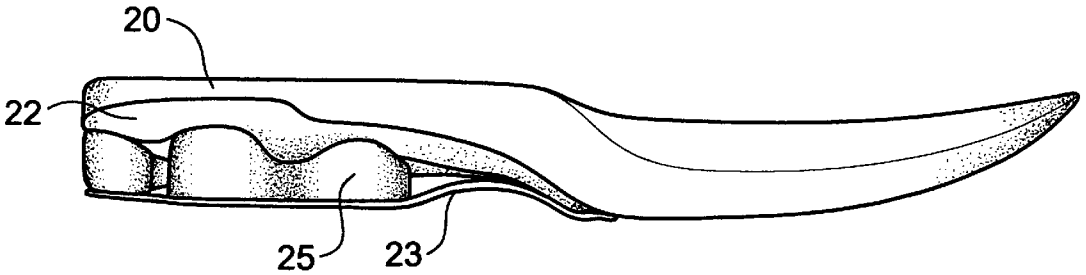
FIG. 5 is an enlarged lateral side elevation view of the present invention footwear shown in FIG. 1 illustrating the relative positioning of the midsole, shock absorption plates and the lateral stabilizing pod.

Sole 12 is formed of several components including a midsole 20 and a forefoot pad 21 and heel pad 26. Midsole 20 may be made from any conventional cushioning materials such as polyurethane or ethyl vinyl acetate. As shown in FIG. 1 and FIG. 5 of the drawing, the elements of the present invention which form a portion of the sole 12 are midsole 20, upper shock absorption plate 22, lower shock absorption plate 23, medial stabilizing pod 24 and lateral stabilizing pad 25. The orientation of the medial and lateral stabilizing pods 25 relative to upper shock absorption plate 22 and lower shock absorption plate 23 can be best seen by reference to FIG. 1 and FIG. 5.

In accordance with the preferred embodiment of the present invention, upper and lower shock absorption plates 22 and 23 and medial and lateral stabilizing pads 24 and 25 are provided. The purpose of the upper and lower shock absorption plates 22 and 23 is to provide cushioning to the foot of the user upon loading or heel strike and a return of usable energy upon shifting of loading from the heel to forefoot. The purpose of medial and lateral stabilizing pods 24 and 25 is to provide stability to the foot of the user as the user's foot proceeds from heel strike through toe off.

During a normal running gait cycle, the foot of a user will roll from heel strike (generally at the lateral side 14 of heel region 15) to midfoot stance wherein the medial side 14 of the sole makes contact with the ground. As stated, the purpose of the stabilizing pods 24 and 25 is to prevent excessive pronation or supination and dynamically adapt to the different forces which may be imposed on the medial and lateral stabilizing pods 24 and 25. During a normal running gait cycle the speed of the natural role of a bare foot is slower than the speed achieved when any type of shoe is placed on the foot. This is because the shoe acts as a lever increasing the speed of roll of the foot. In accordance with the present invention, and as will be discussed in detail hereinbelow, such speed may be controlled and regulated by varying the material hardness and the structure of the medial and lateral pods 24 and 25.

Figure 3:
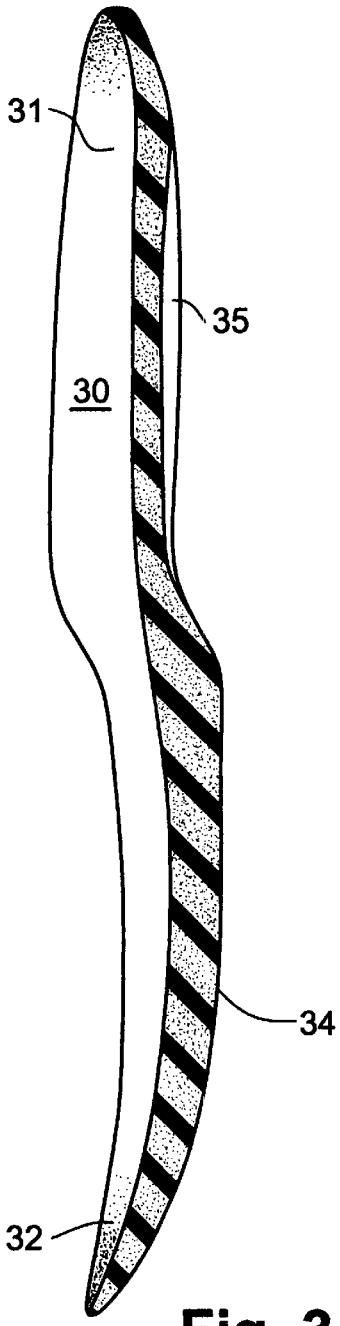
FIG. 3 is cross-sectional view of the midsole shown in FIG. 2 taken through line 3—3 of FIG. 2.
Figure 2:
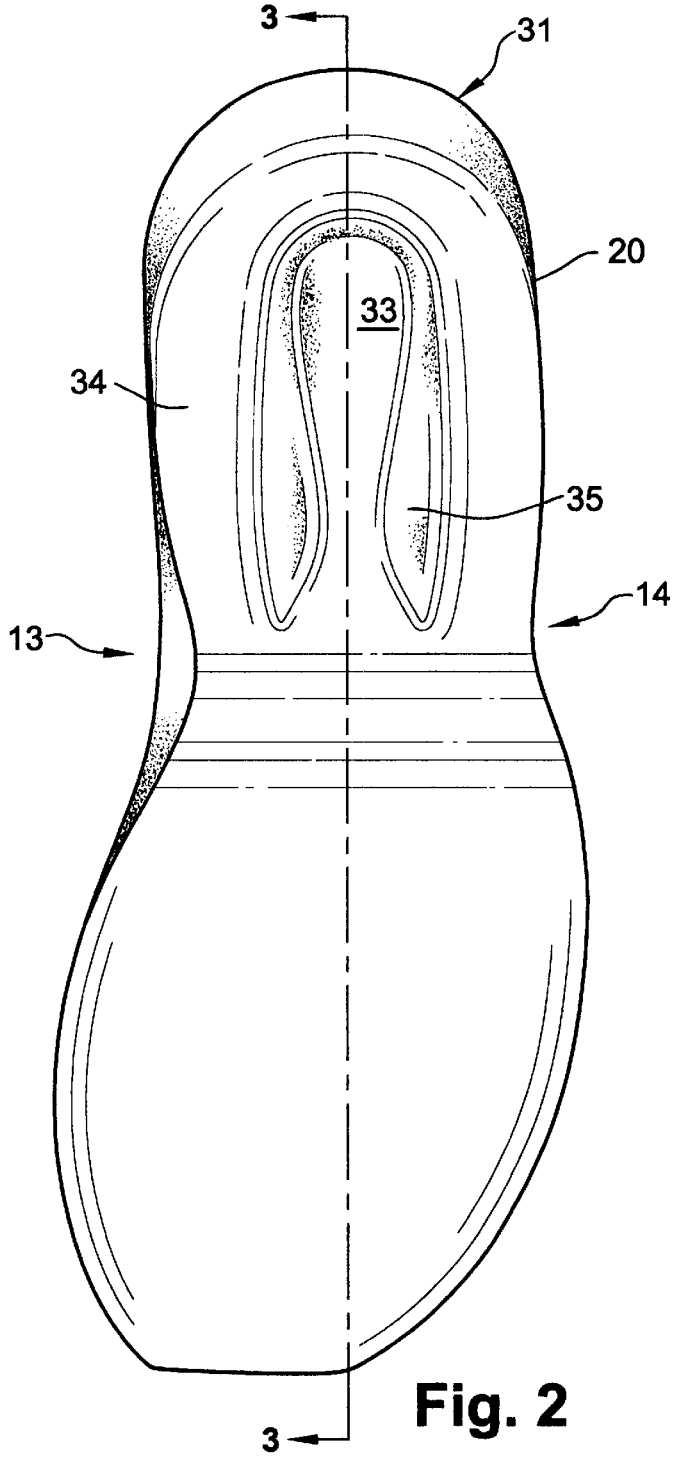
FIG. 2 is a bottom plan view of the footwear midsole shown in FIG. 1.

The construction of the midsole 20 is material to the present invention. As can be seen in FIG. 2 and FIG. 3, midsole 20 has an upper surface 30 divided into a heel region 31 and a forefoot region 32. A recessed convex surface 33 is created in bottom surface 34 of midsole 20. In the preferred embodiment of the present invention, recess 30 is created by extending bottom surface 34 into a U-shaped ridge 35 which defines recess 30. As will be explained hereinbelow, the cooperating engagement of ridge 35 and recess 33 with upper shock absorption plate 22 defines the plane of shock absorption along the longitudinal axis of midsole 20.

Figure 6:
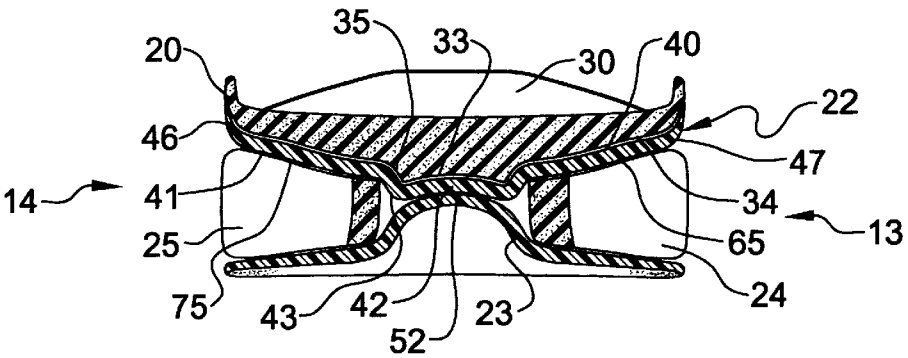
FIG. 6 is a cross-sectional view of the midsole construction shown in FIG. 4 taken through line 6—6 of FIG. 2.
Figure 8:
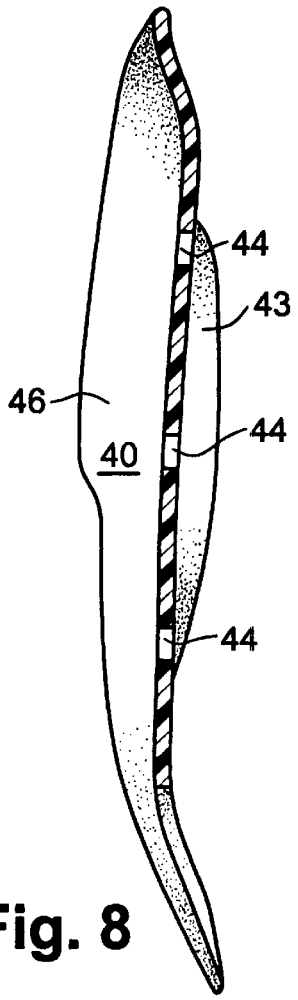
FIG. 8 is a cross-sectional view of the upper shock absorption plate shown in FIG. 7 taken through line 8—8 of FIG. 7.
Figure 7:
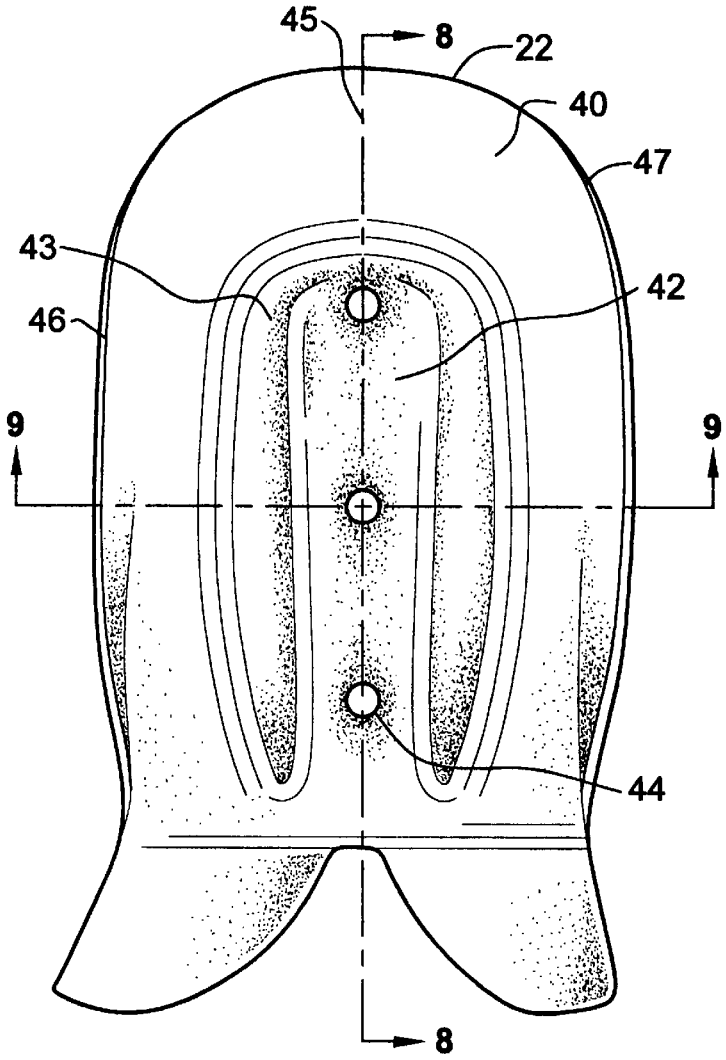
FIG. 7 is a top plan view of the upper shock absorption plate shown in FIGS. 4 and 5.
Figure 9:
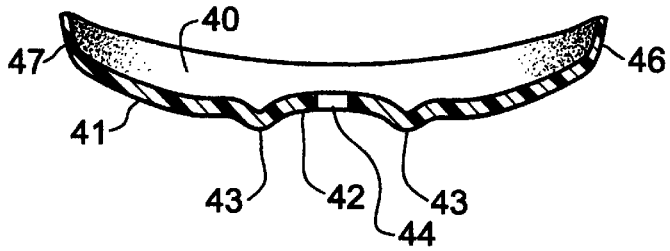
FIG. 9 is a cross-sectional view of the upper shock absorption plate shown in FIG. 7 taken through line 9—9 of FIG. 7.

Upper shock absorption plate 22 can be best seen by reference to FIGS. 7, 8 and 9. Upper shock absorption plate 22 is generally fabricated of a resilient material which may be deflected by the imposition of a force and which will return to its original shape when the force is removed (e.g., polyvinyl chloride; thermoplastic urethane). The top surface 40 of upper shock absorption plate 22 is adapted to be placed snugly adjacent the bottom surface 34 of midsole 20. The rearward profile of upper shock absorption plate 22 can be best reference to FIGS. 6 and 9. The transverse margins 46 and 47 depend upwardly conforming to the respective portions of the bottom surface 34 of midsole 20. As will be explained hereinbelow, the transverse margins 46 and 47 will be caused to be urged inwardly toward each other at heel strike thereby stabilizing the position of the heel of the user. The top surface 40 and the bottom surface 41 are shaped into a concave segment 42 defined by an elongated projection 43 which extends along the longitudinal axis 45. As can be best seen in FIG. 6, concave segment 42 and projection 43 are adapted to be disposed adjacent recess 33 and ridge 35 of midsole 20. A plurality of apertures 44 are disposed through upper shock absorption plate 22 along the longitudinal axis thereof. It is understood that detents formed into bottom surface 41 could be used in lieu of aperture 44. As will be described in detail hereinbelow, apertures 44 are adapted to receive engaging portions of lower shock absorption plate 24 and to position them in proper alignment with one another.

Figure 11:
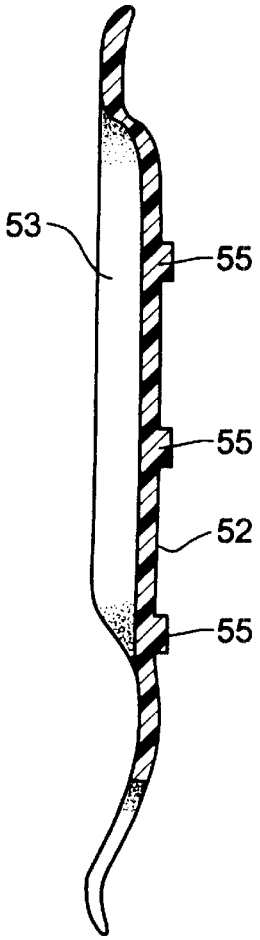
FIG. 11 is a cross-sectional view of the lower shock absorption plate taken through line 11—11 of FIG. 10.
Figure 10:
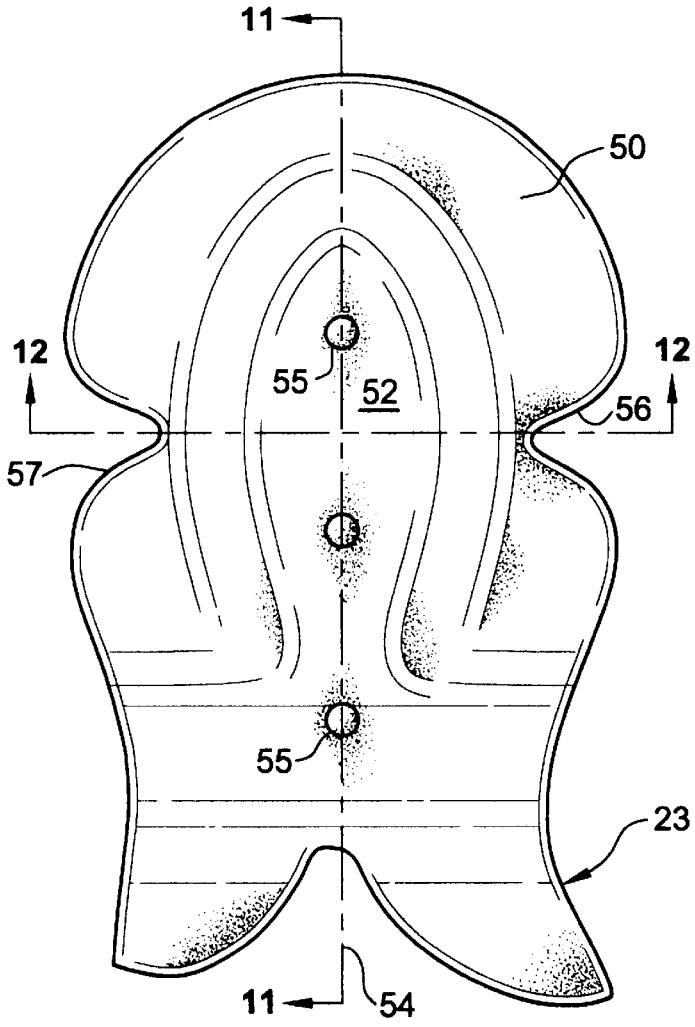
FIG. 10 is a top plan view of the lower shock absorption plate shown in FIGS. 4 and 5.
Figure 12:
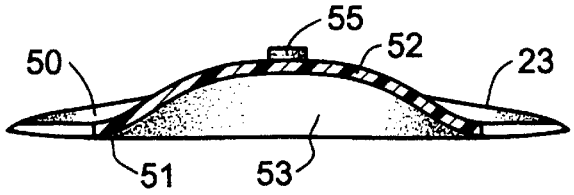
FIG. 12 is a cross-sectional view of the lower shock absorption plate shown in FIG. 10 taken through line 12—12 of FIG. 10.

Lower shock absorption plate 23 can be best understood by reference to FIGS. 10, 11 and 12. Like upper shock absorption plate 22, lower shock absorption plate 23 is fabricated of a resilient material which may be deflected by the imposition of force and which will return to its original shape when the force is removed. As can be best seen in FIG. 12, the top surface 50 and bottom surface 51 are shaped into a concave segment 52 defined by elongated projection 53 which extends along the longitudinal axis 54. As can be best seen in FIG. 6, concave segment 52 and projection 53 are intend to be placed adjacent the bottom surface 41 of upper shock absorption plate 22 in alignment with concave segment 42. A plurality of uniformly spaced pins 55 depend upwardly from the upper surface 50 of concave segment 52 along longitudinal axis 54 of lower shock absorption plate 23. As described hereinabove, the top surface 50 of lower shock absorption plate 23 is adapted to be nested within concave segment 42 of upper shock absorption plate 22. When in place, pins 55 will be engaged within apertures 44 thereby fixing the position of absorption plates 22 and 23 relative to each other (FIG. 6).

Figure 4:
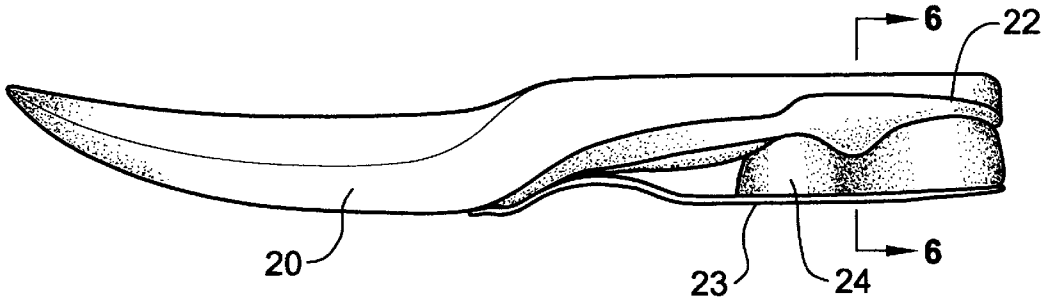
FIG. 4 is an enlarged medial side elevation view of the present invention footwear shown in FIG. 1 illustrating the relative positioning of the midsole, shock absorption plates and the medial stabilizing pod.

As can be seen in FIGS. 4, 5 and 6, medial stabilizing pod 24 and lateral stabilizing pod 25 are disposed intermediate upper and lower shock absorption plates 22 and 23 along the medial and lateral margins thereof. As stated hereinabove, the structure and characteristics of the stabilizing pods 24 and 25 are adapted to generally stabilize the user's foot from heel strike through toe off and, in particular, to stabilize the shoe and thereby reduce pronation of the shoe and the user's foot.

The preferred embodiment of the present invention provides an improved construction for the sole of a shoe which improves shock absorption and stability under normal conditions where initial heel strike is initiated at the lateral side 14 of the heel region 15. As will be explained in detail hereinbelow, it is understood that, through a modification of the configuration of medial and lateral stabilizing pods 24 and 25, the present invention may be adapted to conditions where the nature of physical activities may result in the initial imposition of force being imposed at different locations about the medial and lateral margins of the heel region 15.

Figure 19:
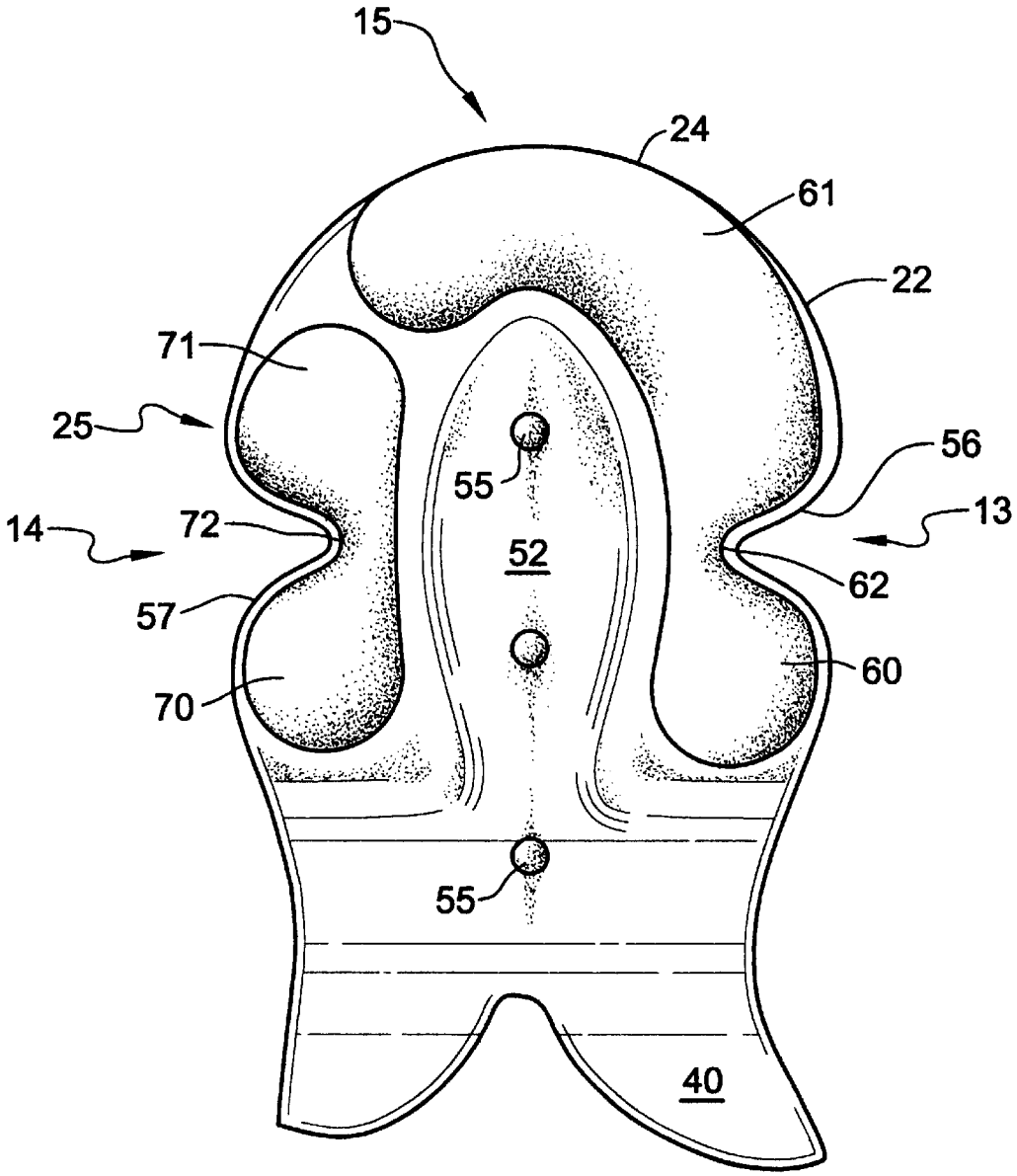
FIG. 19 is a top plan view of the medial and lateral stabilizing pods positioned upon the lower shock absorption plate.

An understanding of the orientation of the preferred embodiment of stabilizing pods 24 and 25 relative to upper and lower shock absorption plates 22 and 23 can be best gained by reference to FIGS. 6 and 19. Medial stabilizing pod 24 is positioned upon the top surface 40 of lower shock absorption plate 22 along the medial side 13 of the shoe. As will be explained in detail hereinbelow, medial stabilizing pod 24 extends from the medial region 13 through the heel region 15 of the shoe. Lateral stabilizing pod 25 is positioned upon the top surface 40 of lower shock absorption plate 23 along the lateral side 14 of the shoe.

A description of the preferred embodiment of medial pod 24 can be best gained by reference to FIGS. 6, 13, 14 and 15. The preferred embodiment of medial pod 24 consists of two segments or lobes 60 and 61. As can be seen from FIG. 19, lobe 60 will be disposed totally along the medial side 13 of the shoe. The curvature of lobe 61 extends from the medial side 13 of the shoe to the heel region 15 following the curvature of the respective portion of upper shock absorption plate 22. Lobes 60 and 61 are separated from each other by an integral segment 62 of stabilizing pod 22 which is less than half of the distance between the exterior and interior surfaces of either lobe 60 or lobe 61. The integral segment 62 allows lobes 60 and 61 to independently and dynamically react to forces imposed from heel strike to toe off.

Figure 14:
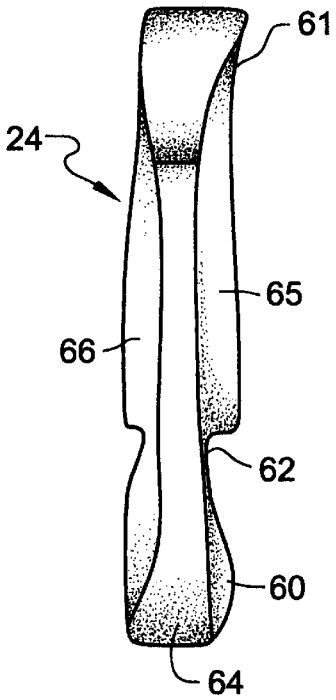
FIG. 14 is an interior side elevation view of the medial stabilizing pod shown in FIG. 13.
Figure 13:
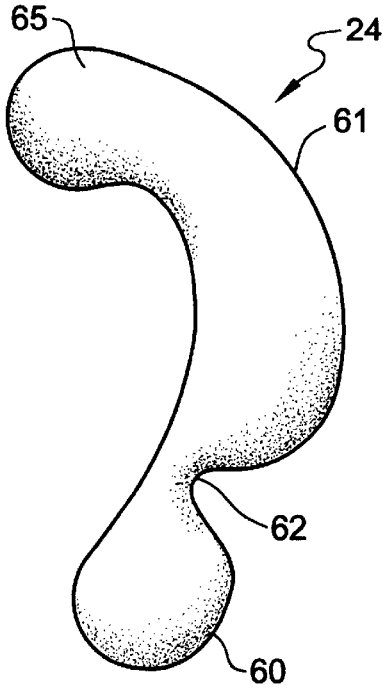
FIG. 13 is a top plan view of a preferred embodiment of the medial stabilizing pod.
Figure 15:
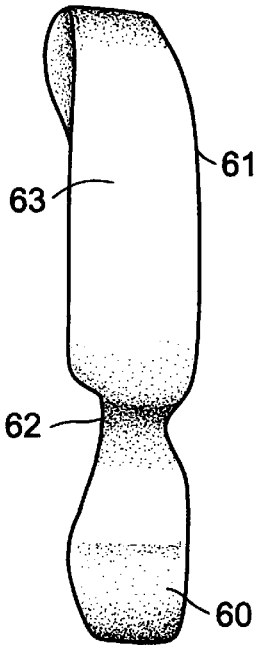
FIG. 15 is an exterior side elevation view of the medial stabilizing pod shown in FIG. 13.
Figure 18:
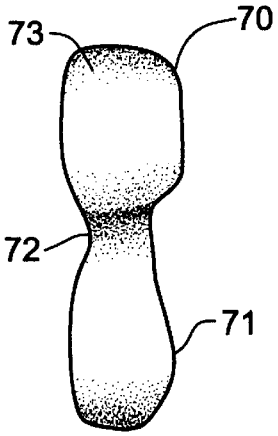
FIG. 18 is an exterior side elevation view of the lateral stabilizing pod shown in FIG. 16.
Figure 16:
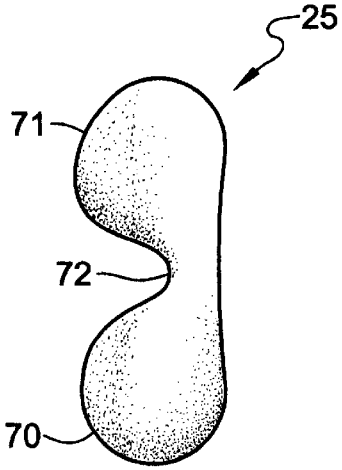
FIG. 16 is a top plan view of the preferred embodiment of the lateral stabilizing pod.
Figure 17:
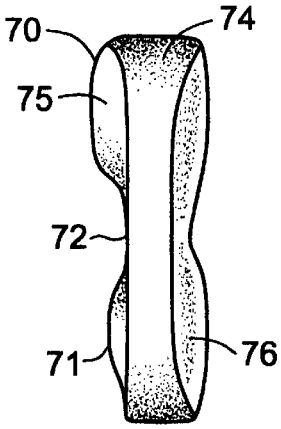
FIG. 17 is an interior side elevation view of the lateral stabilizing pod shown in FIG. 16.

Medial stabilizing pod 24 is defined by exterior surface 63, interior surface 64, top surface 65 and bottom surface 66. In order to insure that medial stabilizing pod 24 can achieve the objectives of the present invention, it must be positioned properly between the medial and lateral margins of the shock absorption plates 22 and 23. As can be seen in FIGS. 6 and 14, to meet this objective the upper surface 65 of medial stabilizing pod 24 is tapered downwardly from the exterior surface 63 to the interior surface 64. As shown in FIG. 6, the tapering of upper surface 65 will insure that the forces imposed upon midsole 20 during heel strike will be uniformly distributed to medial stabilizing pod 24.

An understanding of the structure of lateral stabilizing pod 25 can be best gained by reference to FIGS. 6, 16, 17 and 18. As shown in FIGS. 6 and 19, lateral stabilizing pod 25 is disposed between the lateral margins of the shock absorption plates 23 and 24 solely along the lateral region 14 of the shoe. In the preferred embodiment of the present invention, lateral stabilizing pod 25 comprises two substantially equivalent lobes 70 and 71 separated by an integral segment 72 which is less than one-half of the distance between the exterior and interior surface of either lobe 70 or lobe 71. As discussed in detail hereinbelow, the integral segment 72 separating lobes 70 and 71 allows each of the lobes 70 and 71 of stabilizing pod 25 to respond independently of the other and dynamically react to the forces imposed from heel strike to toe off.

Lateral stabilizing pod 25 is defined by an exterior surface 73, interior surface 74, top surface 75 and bottom surface 76. As with medial stabilizing pod 24, to achieve the objectives of the present invention lateral stabilizing pod 24 must dynamically respond to the forces imposed from heel strike to toe off. As shown in FIG. 6, to achieve this objective, top surface 75 is tapered inwardly from exterior surface 73 to interior surface 74. As shown in FIG. 6, tapered surface 75 insures that forces imposed from heel strike to toe off will be uniformly transmitted to lateral stabilizing pod 25.

In order for the preferred embodiments of medial and lateral stabilizing pods 24 and 25 to stabilize the shoe and the foot of the user, the stabilizing pods are comprised of multiple lobes which will each independently respond to the forces imposed. In the preferred embodiment of the present invention, medial stabilizing pod 24 employs two lobes 60 and 61 and lateral stabilizing pod 25 employs two pods 70 and 71. Each pod 60 and 61 will react independently to the other and dynamically respond to the imposed forces. This is the result of the interface created by integral segment 62. In a like manner, pods 70 and 71 of lateral stabilizing pod 25 will independently respond to the forces imposed through the separation provided by the integral segment 72.

As stated hereinabove, the purpose of the stabilizing pods 24 and 25 is to provide dynamic response and stability from heel contact through toe off. To accomplish this objective, the flexibility of lower shock absorption plate 23 must be responsive to the forces imposed upon stabilizing pods 24 and 25. As stated hereinabove, in the preferred embodiment of the present invention, stabilizing pods 24 and 25 each comprise two lobes separated by integral segments 62 and 72 of medial stabilizing pod 24 and lateral stabilizing pod 25, respectfully. In order to permit lower shock absorption plate 23 to be fully responsive to the forces imposed upon medial and lateral stabilizing pods 24 and 25, the medial and lateral margins of lower shock absorption plate 23 are indented to coincide with integral segments 62 and 72 of stabilizing pods 24 and 25, respectively. As can be seen by reference to FIGS. 10 and 19, indentations 56 and 57 are disposed in the medial and lateral margins of shock absorption plate 23 and are in a substantial alignment with segments 62 and 72 of stabilizing pods 24 and 25, respectively.

The forces imposed on the medial and lateral sides of the shoe differ. In particular, during a normal running gait cycle, the foot of the user will roll from heel strike at the lateral side 14 of the heel region 15 to a midfoot stance wherein the medial side 14 of the sole makes contact with the ground. This can result in the rotation of the medial bones in the midtarsal region of the foot which, as stated hereinabove, is referred to as pronation. Medial and lateral stabilizing pods 24 and 25 are fabricated from resilient, compressible material such as polyurethane or ethyl vinyl acetates. These materials may be provided in varying degrees of hardness. To reduce pronation or supination, medial stabilizing pod 24 is fabricated such that it may be harder and less resistant to compression than lateral stabilizing pod 25. Durometer hardness is an arbitrary numerical value which measures the resistance to penetration. The material used to fabricate medial stabilizing pod 24 will have a durometer measurement which is greater than that of the lateral stabilizing pod 25.

Although the preferred embodiment of the present invention utilizes medial and lateral stabilizing pods comprised of two lobes, it is understood the present invention contemplates the use of medial and lateral stabilizing pods having more than two pods. Adding additional lobes to the stabilizing pods will further localize the dynamic response of any particular element of the stabilizing pods to the imposed forces. Where stabilizing pods are constructed with more thank two lobes, each adjacent pair of lobes will be separated by an integral segment of the pod which is less than half the width of the distance between the exterior and interior surfaces of the pods. It is further understood that the alternative embodiment of the present invention employing stabilizing pods having more than two lobes will also require medial and lateral indentations in the lower absorption plate to coincide with each integral segment of the stabilizing pods.

An alternative embodiment of the present invention may be best gained by FIGS. 20–26. The alternative embodiment of the present invention addresses circumstances where, because of the nature of specific physical activities, the force imposed at heel strike may occur at any location along the lateral or medial side of heel region 15. This requires medial and lateral stabilizing pods which are substantially uniform.

Figure 20:
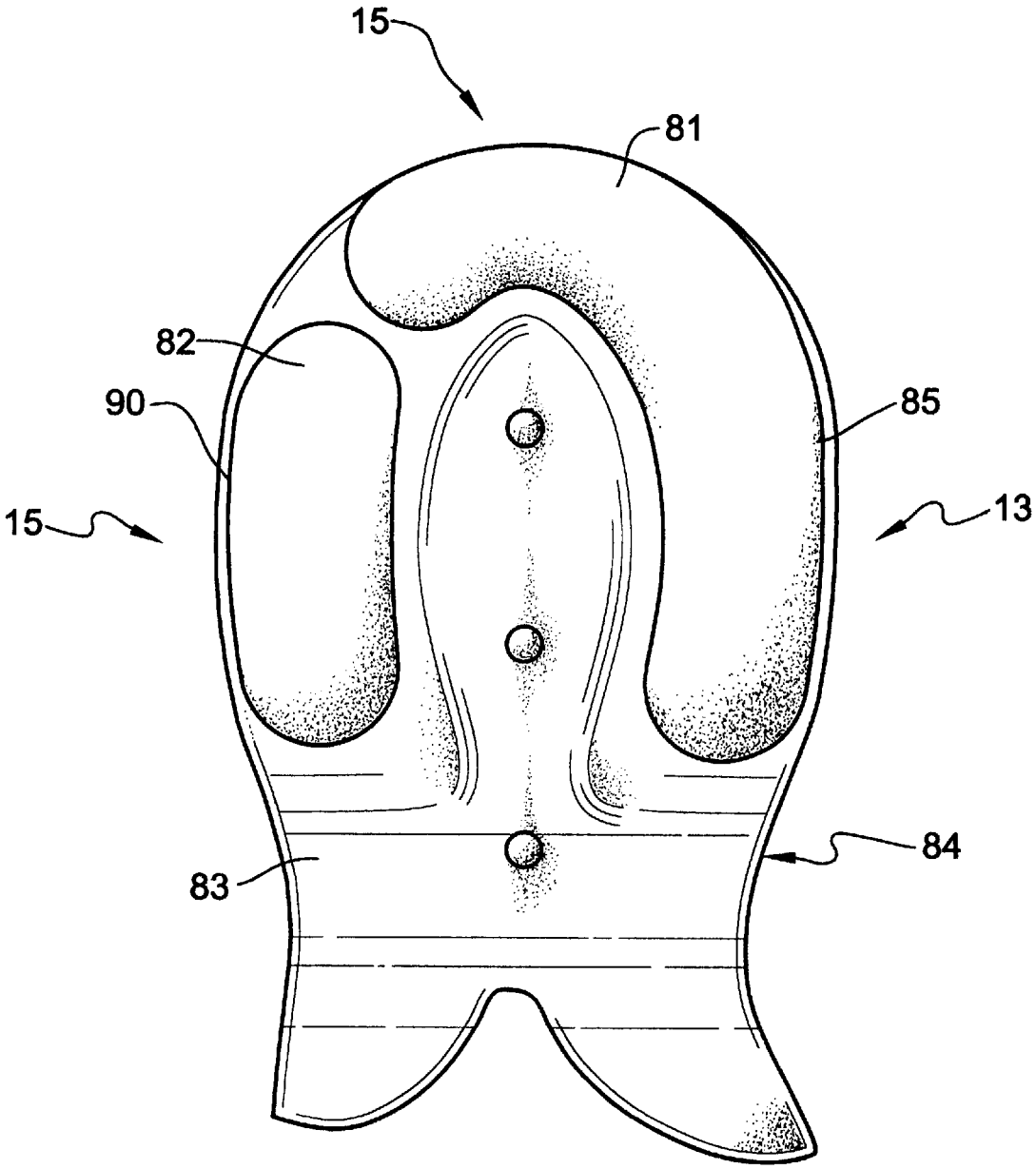
FIG. 20 is a top plan view of an alternative embodiment of the assembled medial and lateral stabilizing pods and the lower shock absorption plate.

As can be best seen in FIG. 20, medial and lateral stabilizing pods 81 and 82 are disposed upon the top surface 83 of a lower shock absorption plate 84. Medial stabilizing pod 81 extends from the medial region of the shoe through the heel region 15 of the shoe. Lateral stabilizing pod 82 is disposed only along the lateral region 14 of the shoe.

Figure 22:
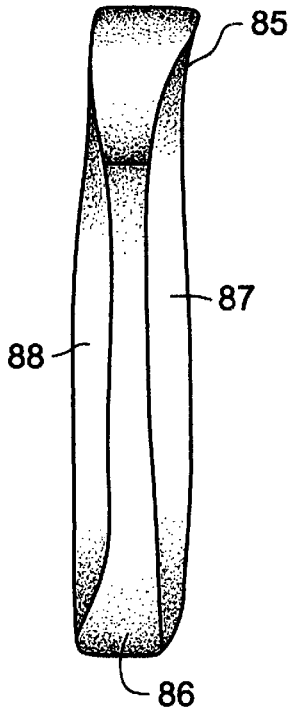
FIG. 22 is an interior side elevation view of the medial stabilizing pod shown in FIG. 21.
Figure 21:
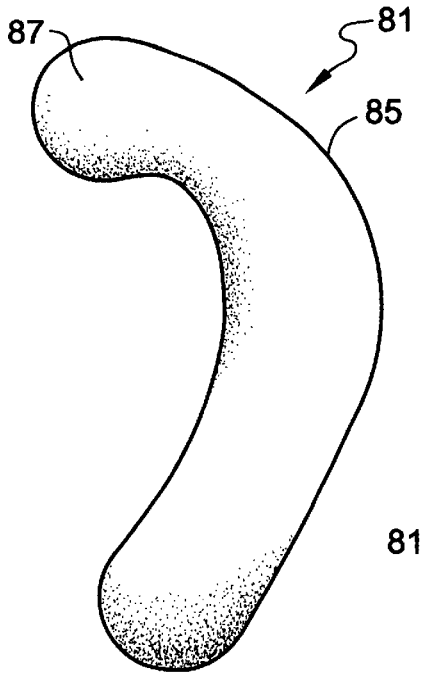
FIG. 21 is a top plan view of an alternative embodiment of a medial stabilizing pod in accordance with the present invention.
Figure 23:
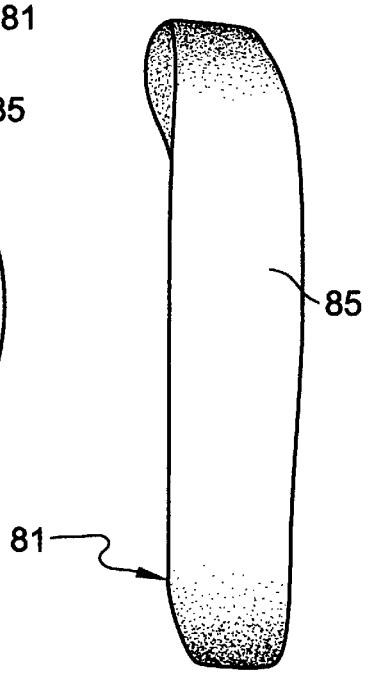
FIG. 23 is an exterior side elevation view of the medial stabilizing pod shown in FIG. 21.

The construction of medial stabilizing pod 81 can be best seen by reference to FIGS. 21–23. Medial stabilizing pod 81 is defined by exterior surface 85, interior surface 86, top surface 87 and bottom surface 88. Medial and lateral stabilizing pods 81 and 82 are positioned between the medial and lateral margins of an upper shock absorption plate (not shown) and lower shock absorption plate 84 in the manner shown in FIG. 6. To meet this objective, the upper surface 87 of medial stabilizing pod 81 is tapered inwardly and downwardly from exterior surface 85 to the interior surface 86.

Figure 26:
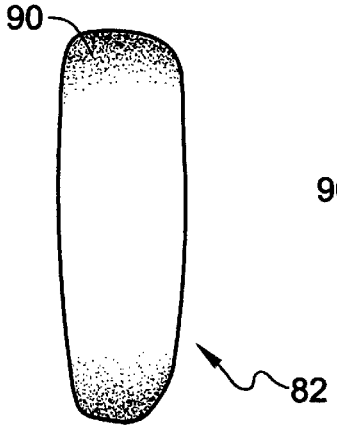
FIG. 26 is an exterior side elevation view of the lateral stabilizing pod shown in FIG. 24.
Figure 24:
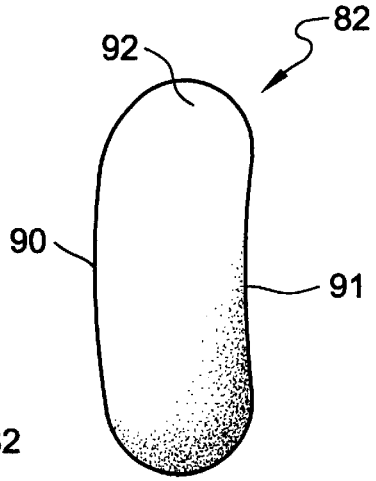
FIG. 24 is a top plan view of an alternative embodiment of the lateral stabilizing pod.
Figure 25:
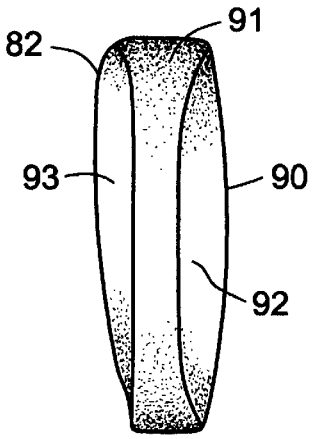
FIG. 25 is an interior side elevation view of the lateral stabilizing pod shown in FIG. 24.

An understanding of the structure of lateral stabilizing 82 can be best gained by reference to FIGS. 24, 25 and 26. Lateral stabilizing pod 82 is disposed between the lateral margins of an upper shock absorption plate (not shown) which is substantially similar to shock absorption plate 23 and lower shock absorption plate 84 (FIG. 20). Lateral stabilizing pod 82 is positioned solely along the lateral region 14 of the shoe. Lateral stabilizing pod 82 is defined by an exterior surface 90, an interior surface 91, a top surface 92 and a bottom surface 93. In a manner which is similar to medial stabilizing pod 85, top surface 92 is tapered inwardly and downwardly from exterior surface 90 to interior surface 91. In the alternative embodiment of the present invention employing medial and lateral stabilizing pods 81 and 82, the medial and lateral margins of the upper shock absorption plate (not shown) and the lower shock absorption plate 84 (FIG. 20) are coextensive with the exterior surfaces 85 and 90 of medial stabilizing pod 81 and lateral stabilizing pod 82, respectively.

The present invention substantially resolves the inadequacies inherent in the footwear designs described in the prior art. The present invention employs structural elements to cooperate together to enhance the shock absorption and stability characteristics of footwear. Upon heel strike, force will be imposed by the user's foot in the heel region 31 of midsole 20. The force will generally be directed through the adjacent concave surfaces 42 and 52 of upper and lower absorption plates 22 and 23, respectively. The flexibility of the absorption plates 22 and 23 will downwardly deflect concave segments 42 and 52 thereby cushioning the foot. When the imposition of force causes concave segments 42 and 52 to be deflected downwardly, transverse margins 46 and 47 of upper shock absorption plate 22 will be urged inwardly toward each other creating inwardly directed forces against the midsole and heel. This will prevent inadvertent lateral movement of the user's heel relative to the midsole. Upon the shifting of loading from the heel to the forefoot of the user, concave segments 42 and 52 will return to their original orientation thereby returning usable energy to shock absorption plates 22 and 23. With regard to stability, the force of the foot from heel strike through toe off will be distributed to the medial and lateral stabilizing pods 24 and 25. The ability of the multi-lobed pods 24 and 25 to dynamically react and distribute forces will improve stabilization of the shoe and the foot of the user and thereby reduce foot pronation.

We claim:

1. Footwear comprising:

(a) a midsole formed of a shock absorbing material, said midsole having a heel region, a medial side, a lateral side and top and bottom surfaces;

(b) a first shock absorbing plate having a top and a bottom surface, the top surface of said first shock absorbing plate being disposed adjacent the bottom surface of the midsole at the heel region and extending from the medial to the lateral side of the midsole, said first shock absorbing plate having an elongated, resilient deflectable segment disposed intermediate said medial and lateral sides thereof;

(c) a second shock absorbing plate having a top and a bottom surface extending from the medial to the lateral side of the midsole and having a second elongated, resilient deflectable segment intermediate said medial and lateral sides thereof, said second deflectable segment being disposed adjacent the bottom surface of said first shock absorbing plate in alignment with the first deflectable segment of said first shock absorbing plate;

(d) a compressible, medial stabilizing pod being disposed between said first and second shock absorbing plates along the medial side of the midsole in contact with the bottom surface of said first shock absorbing plate and said top surface of said second shock absorbing plate; and (e) a compressible, lateral stabilizing pod being disposed between the first and second shock absorbing plates on the lateral side of the midsole and in contact with the bottom surface of said first shock absorbing plate and the top surface of said second shock absorbing plate.

2. Footwear as defined in claim 1 wherein said medial stabilizing pod extends from the medial side to the heel region of the midsole and includes at least two lobes separated by an integral segment of said medial stabilizing pod.

3. Footwear as defined in claim 2 wherein said medial stabilizing pod has an exterior surface, an interior surface and a top surface, said top surface being tapered downwardly from the exterior surface to the interior surface thereof.

4. Footwear as defined in claim 3 wherein the width of the segment between the lobes of said medial stabiizing pod is less than half of the distance between the exterior and interior surfaces of said medial stabilizing pod.

5. Footwear as defined in claim 1 wherein said lateral stabilizing pod includes at least two lobes separated by an integral segment of said lateral stabilizing pod.

6. Foot wear as defined in claim 5 wherein said lateral stabilizing pod has a n exterior surface, an interior surface and a top surface, said top surface being tapered downwardly from the exterior surface t o the interior surface thereof.

7. Footwear as defined in claim 6 wherein the width of the segment between the lobes of said lateral stabilizing pod is less than half of the distance between the exterior and interior surfaces of said lateral stabilizing pod.

8. Footwear comprising:

(a) a midsole formed of a shock absorbing material, said midsole having a heel region, a medial side, a lateral side and a top and a bottom surface;

(b) a first shock absorbing plate disposed adjacent the bottom surface of the midsole at the heel region and extending from the medial to the lateral side of the midsole, said first shock absorbing plate having an elongated, resilient deflectable concave segment disposed between said medial and lateral sides;

(c) a second shock absorbing plate extending from the medial to the lateral side of the midsole and having a second elongated, resilient deflectable concave segment intermediate said medial and lateral sides, said second deflectable concave segment being disposed adjacent to and in alignment with the first deflectable concave segment of said first shock absorbing plate whereby the imposition of force on the top surface of said midsole will result in the deflection of the first and second concave segments.

(d) a compressible, medial stabilizing pod having a plurality of spaced lobes, said medial stabilizing pod being disposed between said first and second shock absorbing plates along the medial side of the midsole; and (e) a compressible, lateral stabilizing pod having a plurality of spaced lobes, said lateral stabilizing pod being disposed between the first and second shock absorbing plates on the lateral side of the midsole.

9. Footwear as defined in claim 8 wherein said medial stabilizing pod extends from the medial side to the heel region of the midsole and includes at least two lobes separated by an integral segment of said pod.

10. Footwear as defined in claim 9 wherein said medial stabilizing pod has an exterior surface, an interior surface and a top surface, said top surface being tapered downwardly from the exterior surface to the interior surface.

11. Footwear as defined in claim 10 wherein the width of the segment between the lobes of said medial stabilizing pod is less than half of the distance between the exterior and interior surfaces of said medial stabilizing pod.

12. Footwear as defined in claim 8 wherein said lateral stabilizing pod has an exterior surface, an interior surface and a top surface, said top surface being tapered downwardly from the exterior surface to the interior surface.

13. Footwear as defined in claim 12 wherein said lateral stabilizing pod includes a plurality of lobes separated by an integral segment of said pod.

14. Footwear as defined in claim 13 wherein the width of the separation between the lobes of said lateral stabilizing pod is less than half of the distance between the exterior and interior surfaces of said lateral stabilizing pod.

15. Footwear comprising:

(a) a midsole formed of a shock absorbing material and including a heel region, a forefoot region, a medial side, a lateral side and top and bottom surfaces, said medial and lateral sides separated by a longitudinal axis extending from the heel region to the forefoot region;

(b) a first shock absorbing plate having a top surface and a bottom surface, the top surface of said first shock absorbing plate being disposed adjacent the bottom surface of the midsole at the heel region and extending from the medial to the lateral side of the midsole, said first shock absorbing plate having elongated, resilient deflectable concave segment aligned with the longitudinal axis of said midsole between the medial and lateral sides thereof;

(c) a second shock absorbing plate having a top surface and a bottom surface extending from the medial to the lateral side of the midsole and having a second elongated, resilient deflectable concave segment intermediate said medial and lateral sides and aligned along the longitudinal axis of the midsole, said second deflectable concave segment being disposed adjacent to and in alignment with the first deflectable segment of said first shock absorbing plate;

(d) engagement means coupled between the bottom surface of said first shock absorbing plate and the top surface of said second shock absorbing plate coupling said first and second deflectable concave segments to one another;

(e) a compressible, medial stabilizing pod having at least two spaced lobes separated by a segment integral with a segment of said pod, said medial stabilizing pod being disposed between said first and second shock absorbing plates along the medial side of the midsole; and (f) a compressible, lateral stabilizing pod having at least two spaced lobes separated by an integral segment of said pod, said lateral stabilizing pod being disposed between the first and second shock absorbing plates on the lateral side of the midsole.

16. Footwear as defined in claim 15 wherein said medial stabilizing pod extends from the medial side to the heel region of the midsole.

17. Footwear as defined in claim 15 wherein the hardness of said medial stabilizing pod is greater than the hardness of said lateral stabilizing pod.

18. Footwear as defined in claim 15 wherein said medial stabilizing pod has an exterior surface, an interior surface and a top surface, said top surface being tapered downwardly from the exterior surface to the interior surface thereof.

19. Footwear as defined in claim 18 wherein the lobes of said medial stabilizing pod are separated by an integral segment of said pod, the width of which is less than half of the distance between the exterior and interior surfaces of aid medial stabilizing pod.

20. Footwear as defined in claim 15 wherein said lateral stabilizing pod has an exterior surface, and interior surface and a top surface, said top surface being tapered downwardly from the exterior surface to the interior surface thereof.

21. Footwear as defined in claim 20 wherein the lobes of said lateral stabilizing pod are separated by a segment of said pod, the width of which is less than half of the distance between the exterior and interior surfaces thereof.

22. Footwear as defined in claim 15 wherein said engagement means comprises at least one engagement member extending upwardly from the top surface of said second shock absorbing plate and an engagement receiver disposed into the bottom surface of said first shock absorbing plate, said engagement member and engagement receiver being aligned and adapted for engagement with one another.

* * * * *